US005416462A

United States Patent [19]

Demarmels et al.

[11] Patent Number: 5,416,462

[45] Date of Patent: May 16, 1995

[54] ELECTRICAL RESISTANCE ELEMENT

[75] Inventors: Anton Demarmels, Schafisheim; Felix Greuter; Ralf Strümpler, both of Baden, all of Switzerland

[73] Assignee: ABB Research Ltd., Zurich, Switzerland

[21] Appl. No.: 122,296

[22] Filed: Sep. 17, 1993

[30] Foreign Application Priority Data

Oct. 1, 1992 [DE] Germany ..... 42 32 969.8

[51] Int. Cl.[6] ..... H01C 7/10

[52] U.S. Cl. ..... 338/22 R; 338/22 SD; 338/23; 338/223; 338/224

[58] Field of Search ..... 338/22 R, 225 D, 23, 338/223, 224; 219/553

[56] References Cited

U.S. PATENT DOCUMENTS

| | | | |
|---|---|---|---|
| 4,534,889 | 8/1985 | van Konynenburg et al. . | |
| 4,616,125 | 10/1986 | Oppitz | 219/553 |

FOREIGN PATENT DOCUMENTS

| | | |
|---|---|---|
| 0430825A1 | 6/1991 | European Pat. Off. . |
| 2746602 | 7/1978 | Germany . |
| 3023621 | 1/1981 | Germany . |
| 3402091A1 | 8/1985 | Germany . |
| 3502838A1 | 8/1985 | Germany . |
| 3640586A1 | 6/1988 | Germany . |
| 3724156A1 | 2/1989 | Germany . |
| 2948350C2 | 2/1990 | Germany . |

OTHER PUBLICATIONS

"Anwendungen elektrisch leitfahiger Kunststoffe", Mair, Leitende Kunststoffe fur elektrotechnische Erzeugnisse, 1986, pp. 10–16.

"Temperaturabhangigkeit des elektrischen Widerstands", Klehiheins, Anwendungen strahlungsvernetzter leitfahiger Kunststoffe, 1986, pp. 80–81, 89–90.

"Fullstoffhaltige elektrisch leitfahige Kunststoffe", Mobius, Kunststoffe 78 (1988), pp. 53–58.

"Elektrisch leitende Kunststoffe", Mair, Werkstoffe, 1988, pp. 946–951.

"Elektrisch leitfahige Polymere", Munstedt, Kunststoffe 79, 1989, pp. 510–514.

*Primary Examiner*—Marvin M. Lateef

*Attorney, Agent, or Firm*—Burns, Doane, Swecker & Mathis

[57] ABSTRACT

An electrical resistance element having a resistance body between two contact terminals. The resistance body has PTC behavior and is composed of a polymer matrix and a filler component embedded in the polymer matrix. The filler component is composed of electrically conducting particles. Although the element is of simple and inexpensive construction, the resistance element is notable for good electrical conductivity in the low-resistance state and for a low response time for the PTC transition from the low-resistance to the high-resistance state. This is achieved as a result of the fact that at least some of the electrically conducting particles are formed as composite bodies having electrically conducting surfaces and/or as hollow or porous bodies composed of electrically conducting material. These particles have a lower specific density and/or lower specific heat capacity than solidly formed particles composed of conductive material.

20 Claims, 1 Drawing Sheet

ELECTRICAL RESISTANCE ELEMENT

FIELD OF THE INVENTION

The invention proceeds from an electrical resistance element saving a resistance body which is disposed between two contact terminals and has PTC behavior and which is composed of at least one polymer matrix and at least one filler component embedded in the polymer matrix and composed of electrically conducting particles.

DISCUSSION OF BACKGROUND

Resistors having PTC behavior have long been prior art and are described, for example, in DE 2 948 350 C2 or U.S. Pat. No. 4,534,889 A. In commercially obtainable designs, such resistors preferably contain resistance bodies composed of a semicrystalline polymer which is filled with soot and which has PTC behavior. Below a material-specific critical temperature, said polymer is in a low-resistance state. Above the critical temperature, the polymer goes over to a high-resistance state. On exceeding the critical temperature, the resistivity of the PTC resistor increases abruptly by many orders of magnitude and an undesirable short-circuit current is therefore effectively limited. PTC resistors can therefore be used as overload protection in circuits. In an electrical circuit designed for high operating currents and high operating voltages, considerable energy, which results in a destruction of the PTC resistor, can be converted during the transition from the low-resistance to the high-resistance state in the PTC resistor. In order to minimize the energy converted, it is therefore of decisive importance for the use of a PTC resistor as current-limiting element in an electrical circuit designed for high operating currents and high operating voltages that the PTC resistor reaches its high-resistance state during overload in the shortest time.

SUMMARY OF THE INVENTION

Accordingly, one object of the invention, is to provide a novel electrical resistance element which has PTC behavior and which, despite simple and inexpensive construction, is distinguished by high electrical conductivity in the low-resistance state and by a low response time for the PTC transition from the low-resistance to the high-resistance state.

The electrical resistance element according to the invention can be produced simply and inexpensively from commercially obtainable components, such as a polymer matrix and a suitable filler. In the low-resistance state it has an electrical resistivity of less than 30 mΩ.cm and can therefore readily be used as current-limiting element in electrical circuits which are designed for high operating currents and high operating voltages.

It is particularly advantageous in this connection that the response time needed for the transition from the low-resistance to the high-resistance state is very low. This is, in particular, a consequence of the suitable selection of the materials needed to produce the resistance element according to the invention. Proceeding from the requirement that the Joule heat released in the PTC resistance element within a time $\delta t$ needed for the transition from the low-resistance to the high-resistance state must be at least as great as the energy which is necessary to heat the material of the resistance body from a nominal temperature T to the temperature $T_c$ in which the transition takes place is given by the following relationship for the behavior of the resistance element:

$$r\cdot(l/A)\cdot I^2(t)\cdot\delta t \geqq A\cdot l\cdot c_p\cdot d\cdot(T_c-T),$$

where r is the electrical resistivity,

A is the cross-sectional area, l is the length, d is the specific density and $c_p$ is the specific heat capacity of the resistance body of the resistance element, through which a time-variable current I(t) flows. It can be seen from this that, under boundary conditions determined by the resistivity and the geometrical dimensions of the resistance body, the response time is short if, to suit the resistance element according to the invention, the specific heat and/or the specific heat capacity of its resistance body is kept as low as possible.

In a preferred embodiment of the resistance element according to the invention, a low specific density and/or a low specific heat capacity are/is achieved as a result of the fact that the electrically conducting particles of the filler embedded in the polymer matrix are in each case of spherical, fibrous or platelet-like form and are preferably present in each case in the form of a composite body. Such a composite body generally has in each case a supporting body which is superficially coated with a layer of conductive material and which is preferably of hollow, porous or solid construction and which is composed of a material having a lower specific density and/or lower specific heat capacity than the conductive material.

A further appreciable reduction in the response time can be achieved if at least some of the polymer matrix is formed from polymer foam.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
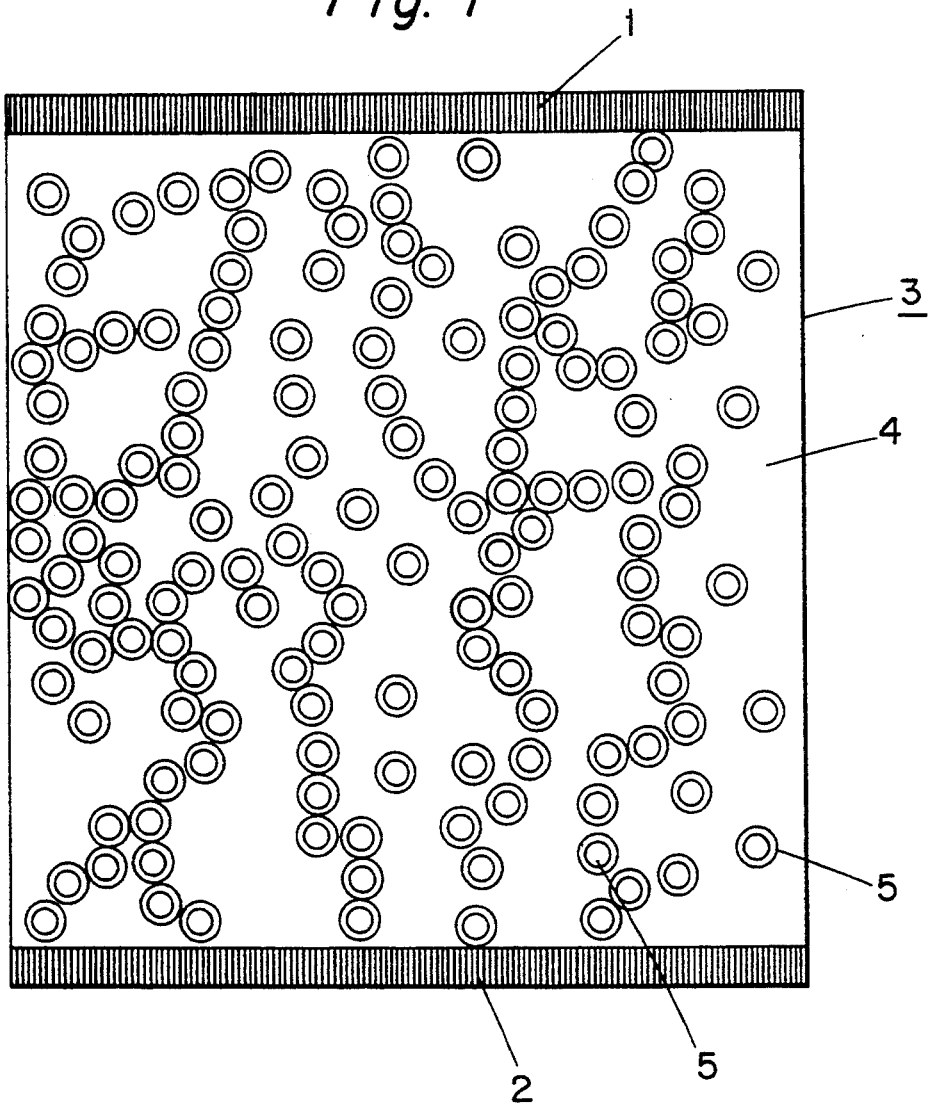
FIG. 1 shows a view of a section through a typical embodiment of the electrical resistance element according to the invention.

Referring now to the drawings, wherein like reference numerals designate identical or corresponding parts throughout the several views, the resistance element shown in FIG. 1 contains a resistance body 3 which is disposed between two contact terminals 1, 2 and has PTC behavior. Below a critical temperature $T_c$, said resistance element has a low cold resistivity and, after incorporation in an electrical power supply to be protected by current limitation, has at least one path which extends between the two contact terminals 1, 2 and preferably carries rated current. Above the critical temperature $T_c$, the resistance element has a high hot resistivity compared with its cold resistivity.

The resistance body 3 is formed from a polymer matrix 4 which preferably contains a thermosetting plastic or thermoplastic or an elastomer. Embedded in said matrix 4 are fillers formed from electrically conducting particles 5. At least some of the particles 5 are formed in each case as composite body having electrically conducting surface and/or as hollow or porous body composed of electrically conducting material. The particles 5 have in each case a lower specific density and/or a lower specific heat capacity than solidly formed particles composed of conductive material.

Figure 2:
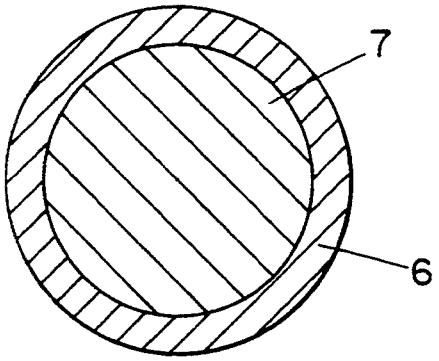
FIG. 2 shows a view of a section made centrally through a particle, formed as a sphere, of a filler provided in the resistance element shown in FIG. 1.
Figure 3:
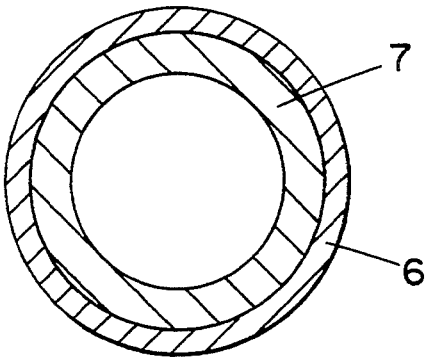
FIG. 3 shows a view of a section made centrally through a particle, formed as a hollow sphere, of a filler provided in the resistance element shown in FIG. 1.

The structure and the constitution of particles 5 particularly to be preferred can be seen in FIGS. 2 and 3. Said particles are obviously formed as composite bodies and have in each case a supporting body 7 which is superficially coated with a layer 6 composed of conductive material and which is composed of a material having a lower specific density and/or lower specific heat capacity than the conductive material. A resistance element containing particles 5 formed in this way has virtually the same electrical conductivity in the low-resistance state as a similarly dimensioned resistance element which, in contrast thereto, contains solidly formed particles. Since, however, it has a lower specific density and/or lower specific heat capacity than a resistance element filled with solidly formed particles composed of conductive material, the response time during the transition from the low-resistance to the high-resistance state is substantially reduced in the case of such a resistance element.

In embodiments of the invention which are particularly easy to produce, the supporting bodies 7 of the particles 5 are formed, as shown in FIG. 2, as solid spheres or are formed, as shown in FIG. 3, as hollow spheres. A resistance element containing solid spheres has a somewhat higher heat conduction and, consequently, also a somewhat higher rated current-carrying capacity than a resistance element containing hollow spheres. On the other hand, a resistance element containing hollow spheres is notable for a lower mass, a lower specific density, a lower specific heat capacity and, consequently, a shorter response time. In addition, for pulse times which are shorter than the time for the propagation of heat over the particles, the somewhat lower heat conduction in a resistance element containing hollow spheres is not perceptible.

The conductive material forming the layers 6 may contain predominantly carbon and/or a metal, such as Ag, Au, Ni, Pd and/or Pt, and/or at least one boride, silicide, oxide and/or carbide, such as for instance SiC, TiC, $TiB_2$, $MoSi_2$, $WSi_2$, $RuO_2$ or $V_2O_3$, in each case in undoped or doped form.

In contrast, the supporting body is formed from a polymer, from glass or from a ceramic. In this connection, a thermosetting plastic, for instance based on epoxide or phenol, a thermoplastic or, alternatively, an elastomer may be used as polymer.

Commercially obtainable phenolic resin spheres coated with silver and having diameters of 1 to 50 μm have proved highly successful as polymeric supporting bodies 7. Suitable glass-containing or ceramic supporting bodies are commercially obtainable spheres based on amorphous quartz or another glass, and on $Al_2O_3$, ZnO, mica, mullite or porcelain. ZnO supporting bodies are produced in the manufacture of varistors by spray drying of powder suspensions and subsequent sintering. In addition to spherical shape, the supporting bodies may also have fibrous shape or platelet shape. In addition, they may not only be solid or hollow, but they may also have a porous, sponge-like structure. To be preferred is a ceramic or glass-like foam material, for instance based on TiC or $TiB_2$, whose surface has been impregnated with a metallic material. Sponge-like bodies which can be used as conductive particles 5 without coating can be formed from metal.

The coating of the supporting bodies 7 can be achieved by known processes, such as for example chemical vapor deposition, sol-gel technology, or precipitation and/or electrolytic coating. The thicknesses of the layers 6 of the particles 5 produced in these cases is preferably between 0.05 and 5 μm, whereas the diameter of the particles is typically between 1 and 200 μm.

To produce a resistance element according to the invention, a filling component containing the particles 5 is mixed into a polymer containing, for example, an epoxy or a thermoplastic using a shearing mixer or an extruder. Typically, the proportion of filler is approximately 40 percent by volume of the composite formed in this process. Said composite is molded to form the resistance body 3 by hot pressing in the case of thermoplastics and by casting and subsequent curing at elevated temperature in the case of epoxides. The contact terminals 1, 2 are applied by pressing-in or casting-in during the molding, or by means of a low-melting solder after the molding. The dimensions of the resistance element formed in this manner depend on the particular application and may, for example, be plate-shaped, tubular, or rod-shaped with typical diameters in the millimeter to centimeter range.

In a further embodiment of the resistance element according to the invention, the supporting bodies 7 may in each case also be formed as hollow spheres composed of conductive material and the polymer matrix 4 embedding the particles 5 may be formed at least partly from polymer foam.

In normal operation, the fillers provided in the resistance body 3 of the resistance element form low-resistance current paths which pass through the resistance body 3. As a result of an overcurrent, the resistance element heats up strongly and, above the critical temperature $T_c$ goes over to a high-resistance state in which the overcurrent is limited. Compared with the response times of resistance elements according to the prior art having equally large dimensions, the response times of resistance elements according to the invention are in some cases quite appreciably shortened in the case of high overload currents. For the same geometrical dimension of the resistance elements and the particles 5, a proportion of filler of 40 percent by volume in each case, and the same overload currents, and with $TiB_2$ as electrically conducting material in each case, the appreciable shortenings of the response times shown in the list provided below are obtained compared with a resistance element according to the prior art containing filler particles composed of solid $TiB_2$ and an epoxy polymer matrix:

| Filler | Polymer matrix | Shortening of the response time in % |
|---|---|---|
| $TiB_2$m solid | Epoxy | — |
| $TiB_2$, solid | Epoxy foam | 12 |
| Quartz spheres/$TiB_2$ | Epoxy | 9 |

-continued

| Filler | Polymer matrix | Shortening of the response time in % |
|---|---|---|
| Quartz spheres/$TiB_2$ | Epoxy foam | 25 |
| Hollow quartz spheres/$TiB_2$ | Epoxy | 15 |
| Hollow quartz spheres/$TiB_2$ | Epoxy foam | 33 |

Obviously, numerous modifications and variations of the present invention are possible in light of the above teachings. It is therefore to be understood that within the scope of the appended claims, the invention may be practiced otherwise than as specifically described herein.

What is claimed is:

1. An electrical resistance element having a resistance body which is disposed between two contact terminals and has PTC behavior and which is composed of at least one polymer matrix and at least one filler component embedded in the polymer matrix, the filler component being composed of electrically conducting particles, at least some of the electrically conducting particles comprising filler bodies selected from the group consisting of a composite body having an electrically conductive surface, a hollow body of electrically conducting material and a porous body of electrically conducting material, the filler bodies having a lower specific density, a lower specific heat capacity or a lower specific density and a lower specific heat capacity than solidly formed particles composed only of conductive material.

2. The resistance element as claimed in claim 1, wherein the filler bodies have a spherical, fibrous or platelet-like form.

3. The resistance element as claimed in claim 1, wherein the composite body comprises a supporting body which is superficially coated with a layer of conductive material and the supporting body is composed of a material having a lower specific density, a lower specific heat capacity or lower specific density and a lower specific heat capacity than the conductive material.

4. The resistance element as claimed in claim 3, wherein the supporting body has a porous structure.

5. The resistance element as claimed in claim 3, wherein the supporting body comprises a solid sphere.

6. The resistance element as claimed in claim 3, wherein the supporting body comprises a hollow sphere.

7. The resistance element as claimed in claim 1, wherein the conductive material is selected from the group consisting of carbon, a metal a boride, a silicide, an oxide, a carbide and mixture thereof.

8. The resistance element as claimed in claim 2, wherein the supporting body is selected from the group consisting of a polymer, glass, and a ceramic.

9. The resistance element as claimed in claim 1, wherein the particles have diameters of between 1 and 200 μm.

10. The resistance element as claimed in claim 2, wherein the thickness of the surface coating applied to the supporting body is between 0.05 and 5 μm.

11. The resistance element as claimed in claim 1, wherein at least a part of the polymer matrix is formed from polymer foam.

12. The resistance element as claimed in claim 7, wherein the metal is a metal selected from the group consisting of Ag, Au, Ni, Pd, Pt and mixtures thereof.

13. The resistance element as claimed in claim 7, wherein the boride, silicide, oxide, carbide or mixture thereof is selected from the group consisting of SiC, TiC, $TiB_2$, $MoSi_2$, $WSi_2$, $RuO_2$ and $V_2O_3$ in doped or undoped form.

14. The resistance element as claimed in claim 8, wherein the polymer comprises a phenolic resin.

15. The resistance element as claimed in claim 8, wherein the glass comprises quartz glass.

16. The resistance element as claimed in claim 8, wherein the ceramic is selected from the group consisting of $Al_2O_3$, ZnO, mica, mullite and porcelain.

17. The resistance element of claim 1, wherein the electrical resistance heating element exhibits high electrical conductivity in a low-resistance state and a low response time for PTC transition from the low-resistance state to a high-resistance state at which the resistance element is effective in providing overload protection of an electrical current passing between the contact terminals.

18. The resistance element as claimed in claim 17, wherein the resistance element has an electrical resistivity of less than 30 mΩ.cmin the low-resistance state.

19. The resistance element as claimed in claim 17, wherein the particles form low-resistance current paths when the resistance element is in the low-resistance state.

20. The resistance element as claimed in claim 17, wherein the filler component is present in an amount of about 40 percent by volume of a total amount of the polymer matrix and filler component.

* * * * *